US009879509B2

(12) United States Patent
De Almeida

(10) Patent No.: US 9,879,509 B2
(45) Date of Patent: Jan. 30, 2018

(54) GAS LIFT NOZZLE VALVE

(75) Inventor: Alcino Resende De Almeida, Tijuca-RJ (BR)

(73) Assignee: PETROLEO BRASILEIRO S.A. -PETROBRAS, Rio de Janeiro (BR)

( * ) Notice: Subject to any disclaimer, the term of this patent is extended or adjusted under 35 U.S.C. 154(b) by 769 days.

(21) Appl. No.: 13/381,864

(22) PCT Filed: May 13, 2010

(86) PCT No.: PCT/BR2010/000153

§ 371 (c)(1),
(2), (4) Date: Mar. 26, 2012

(87) PCT Pub. No.: WO2011/006220

PCT Pub. Date: Jan. 20, 2011

(65) Prior Publication Data

US 2012/0186662 A1 Jul. 26, 2012

(30) Foreign Application Priority Data

Jul. 13, 2009 (BR) ..... PI0902281-3

(51) Int. Cl.
*E21B 43/12* (2006.01)

(52) U.S. Cl.
CPC ..... *E21B 43/123* (2013.01); *E21B 43/121* (2013.01); *E21B 43/122* (2013.01); *Y10T 137/2934* (2015.04)

(58) Field of Classification Search
CPC ..... E21B 43/121; E21B 43/122; E21B 43/123
USPC ..... 137/155; 166/321, 325
See application file for complete search history.

(56) References Cited

U.S. PATENT DOCUMENTS 3,092,131 A 6/1963 Lamb
3,575,194 A * 4/1971 McMurry ..... E21B 43/123 137/155
5,707,214 A 1/1998 Schmidt
6,511,041 B2 1/2003 Faustinelli
6,932,581 B2 8/2005 Messick
7,086,417 B2 8/2006 De Almeida

FOREIGN PATENT DOCUMENTS

EP 1 360 418 A1 11/2003

OTHER PUBLICATIONS

Definition of "toroid" from dictionary.com http://dictionary.reference.com/browse/toroid, no date.*
Definition of "toroidal" from dictionary.com http://dictionary.reference.com/browse/toroidal, no date.*
Definition of "convex" from dictionary.com http://dictionary.reference.com/browse/convex, no date.*
Definition of "convex" from thefreedictionary.com http://www.thefreedictionary.com/convex; no date.*

* cited by examiner

*Primary Examiner* — Kevin Murphy
*Assistant Examiner* — Kelsey Cary
(74) *Attorney, Agent, or Firm* — Sughrue Mion, PLLC

(57) ABSTRACT

The present invention relates to the design of a nozzle valve (GL) for gas lifting that can be used in place of conventional orifice valves (VO).
The gas lift nozzle valve (GL) according to the present invention has a body (1) with admission orifices (2), and, immediately below these, a slight recess (3) in the internal diameter of the body where a convergent nozzle (4) is fitted to regulate the gas flow passing through the inside of the nozzle valve (GL) towards the outlet (5) of the latter.

12 Claims, 12 Drawing Sheets

GAS LIFT NOZZLE VALVE

CROSS REFERENCE TO RELATED APPLICATIONS

This application is a National Stage of International Application No. PCT/BR2010/000153 filed May. 13, 2010, claiming priority based on Brazilian Patent Application No. PI 0902281-3 filed Jul. 13, 2009, the contents of all of which are incorporated herein by reference in their entirety.

SCOPE OF THE INVENTION

The present invention relates to the field of gas-injection valves in tubings in underground oil wells that use gas lift as artificial lift method. More specifically, the invention relates to nozzles fitted inside a valve body to control gas flow instead of conventional valves fitted with an orifice plate.

BACKGROUND TO THE INVENTION

Oil extraction and production systems can vary as a function of the geological formation of the reservoir and the characteristics of the fluids thereof. Having determined the location of a reservoir, wells are created using drills or drilling rigs.

A well passes through several rock formations and a steel pipe, known as the "casing", is normally inserted and cemented into it. At least one pipe of lesser diameter, known as the "tubing", is placed inside the casing, through which flow the fluids from the reservoir(s).

If the pressure accumulated in the reservoir is sufficiently high, the oil is naturally expelled from the reservoir through the wells, this technique only requiring the installation of a pipe that communicates this reservoir with the external means. These wells are known as "flowing wells".

The pressure in the reservoir may also be very low, resulting in production with a less-than-desired or even zero flow rate. In this case, the well requires external intervention to extract the oil from the reservoir. These wells are known as "artificial lift production" wells. This intervention involves means such as mechanical extraction using pumps inside the well or gas lifting, which is the injection of gas at the bottom of the well, supplementing the gas naturally occurring in the fluid flow of the reservoir.

In a conventional arrangement for the latter method, high-pressure natural gas is injected into a space in the well, known as the annulus, which is formed between the casing of this well and the tubing.

At certain points along the tubing are installed valves known as "gas-lift valves", which are primarily intended to enable the controlled flow of gas injected into the annulus to the inside of this tubing.

The valves are installed in piping accessories known as mandrels. There are essentially two types of mandrel: conventional and side-pocket mandrels. Conventional mandrels require the tubing to be removed to replace valves after the well has been fitted. Conversely, with side-pocket mandrels, valves can be removed using a steel-wire operation known as "wireline", without the need to remove the tubing. Consequently, side-pocket mandrels constitute a significant advantage and are therefore the most commonly used. There are some minor structural differences between valves designed for one type of mandrel or the other, but the internal elements are essentially the same and a person skilled in the art would only require a description of a valve for one type of mandrel to determine the adaptations required for use with the other type of mandrel.

In fact, not all of these valves are used in normal operating circumstances. Some of them are only opened during unloading of the well following a rig intervention, or if it is necessary to restart production as a result of a production stoppage of the well, be it accidental or planned.

Normally, the injection of gas from the annulus to the inside of the tubing is effected by just one gas-lift valve, usually the one that is at the deepest point of the well, known as the operating valve.

Although arrangements with several unloading valves and an operating valve are very common, there are practical situations where just one gas-lift valve is placed in the well, this valve then acting both as operating valve and unloading valve, when required.

When it comes into contact with the fluids inside the tubing, the injected gas expands, causing a reduction in the apparent density of the multi-phase mixture and enabling the fluids coming from the reservoir to flow at a given rate.

In addition to gas-lift valves inside the well, it is also common to install some sort of control valve outside the well to regulate the injection pressure of the gas into the annulus. This valve is often simply a gas injection choke.

The gas may be injected continuously and without interruption, which is known as continuous gas lifting. Alternatively, it may be injected intermittently, according to injection and idle cycles, which is known as intermittent gas lifting. The latter method is generally used in wells draining low-productivity reservoirs, while the continuous method is used in high-productivity wells. The gas-lift valves in both injection methods (continuous or intermittent) are identical or very similar.

In conventional arrangements of wells with continuous gas-lift systems, the most conventional models of operating valves use an element, fitted into a recess inside the body of said valve, to regulate the rate of gas injection in the form of a small cylindrical disc or plate the centre of which has a circular orifice of a specific diameter. This disc is also known as an "orifice plate" or valve "seat". The orifice has sharp or slightly chamfered edges.

Conventional unloading valve models, in addition to the aforementioned regulating element (orifice plate), have an opening and closing mechanism, generally a bellows charged with nitrogen that, as a function of the pressures in the annulus and the tubing, controls a rod having a spherical or conical tip that seals the orifice of the seat, preventing the gas injection, or remains in a withdrawn position in which injection is possible at a given flow rate.

Gas-lift valves are also provided with at least one check valve, located downstream of the orifice, such as to prevent any unwanted leaking of the oil from inside the tubing towards the annulus when the pressure differential is conducive to this reverse flow, which may occur during a production stoppage.

The shape of the orifice plate naturally leads to the appearance of vortices. Thus, the gas flow attains a high degree of irreversibility and causes a significant pressure drop.

An additional challenge to be overcome is the generation of major difficulties related both to the calculation of gas flows through the perforated disc and to the modelling and analysis of the results of the design itself.

Developments in research into a solution for the aforementioned issues have led the applicant to design a gas-lift valve that uses a venturi instead of the perforated disc with sharp edges.

Indeed, it has been observed that the irreversibilities of the gas flow are greatly reduced and the diffuser caused a significant recovery of pressure. As a result, the critical gas flow is reached with a lower pressure differential through the valve than that required in a traditional orifice valve and, therefore, the gas flow is easier to keep constant.

However, in a gas-lift valve that uses a venturi, hereinafter referred to simply as a venturi valve, the so-called subcritical region of the performance curve is very narrow and, therefore, it is not possible to operate in this region, because the variations in gas flow injection rate as a function of the pressure variations in the tube are huge and the instabilities induced in the flow constitute a major hazard to operation.

The venturi valve can therefore be used in practice as a device for injecting a constant gas flow, i.e. to operate in the critical region. In orifice valves, the pressure differential required for critical flow is very high for practical standards and operation occurs in the sub-critical region.

Although the venturi valve solves significant problems in this lifting technique, it adds a major problem relating to the operational flexibility of the installation, because it is not possible to achieve relatively large variations in the gas flow rate by varying the pressure in the casing, which is how well characteristics are adjusted to optimise flow rate from an economic perspective when using continuous gas lifting.

In practice, on account of this reduced flexibility, designers prefer to use old orifice valves in situations that will require relatively large variations in gas injection flow rates throughout the production life of the well and they want to avoid having to undertake costly valve-replacement work.

It would be beneficial for the art to develop a valve for use in gas lifting operations that combined high performance with application flexibility in different design situations.

RELATED ART

The art related to the present invention is directly linked to patent documents that are owned by the applicant, and they are briefly mentioned below for reference purposes only.

Document PI 9300292-0 (Alcino Resende de Almeida) concerns an improvement made to orifice valves that uses an optimised seat geometry that makes the gas flow inside the valve more similar to an isentropic flow to significantly reduce the drawbacks of orifice valves. The compact-venturi arrangement results from coupling a convergent nozzle with a conical diffuser, i.e. a venturi nozzle.

The invention provided significant advantages over the prior art in the use of orifice valves as operating valves by enabling operation in the critical region (constant injection flow) with a very low pressure differential.

Document PI 0100140-0 (Alcino Resende de Almeida) discloses an improvement to venturi valves by disclosing a center-body venturi in which the gas flows through an annulus between a cylindrical or conical housing and a central body of variable diameter forming an annular nozzle, an annular throat and an annular diffuser.

This device provides significant improvements because, unlike a normal venturi valve, there is no risk of any debris in the gas flow completely blocking the flow of gas through the valve. In addition to this, they are easier and cheaper to manufacture. In one structural embodiment, the central body can move longitudinally and act against a seat thereby forming a second check valve, which increases the reliability of the valve by preventing the unwanted flow of oil inside the tubing towards the annulus.

The characteristics of the nozzle valve for gas lifting to which this invention relates can be better understood from the detailed description given below, purely by way of example, which relates to the drawings mentioned below, which are an integral part of the present description.

SUMMARY OF THE INVENTION

The object of the present invention is to design a nozzle valve for gas lifting that can be used in place of conventional orifice valves.

The object of this invention is achieved by building convergent nozzles fitted internally to a valve body. These nozzles, on account of their geometric arrangement, provide the valve with the desired characteristics present in orifice valves, with the advantage of providing a discharge coefficient close to one and a real critical ratio close to the theoretical critical ratio. These modified characteristics considerably reduce uncertainty when calculating the gas flow injected into the tubing and make a more efficient contribution to the dimensioning, operation and automation of the well.

The build characteristics of the nozzle valve according to the present invention also provide greater resistance against erosion and, consequently, facilitate a quicker unloading of the wells.

A preferred embodiment generically comprises a cylindrical block to be fitted into a valve body, with an upper circular face and a lower circular face, and, aligned with the generator of the cylindrical block, a toroidal opening that starts wide in the upper face of the cylindrical block and ends in an orifice in the lower face of the cylindrical block.

The nozzle and the valve according to the present invention are not limited to use in artificial gas lifting in oil wells, this valve being able to be used in gas wells, in water-, gas- or steam-injection wells and in other applications, replacing the orifice valves originally used.

DETAILED DESCRIPTION OF THE INVENTION

The detailed description of the nozzle valve for gas lifting to which the present invention relates is provided using the identification of the component parts thereof and the aforementioned figures.

The present invention relates to the design of a nozzle valve for gas lifting that can be used in place of conventional orifice valves.

The objective of this invention is achieved by building convergent nozzles to be fitted internally to a valve body. These nozzles, on account of their geometric arrangement, provide the valve with the desired characteristics present in orifice valves, with the advantage of providing a discharge coefficient close to one and a real critical ratio close to the theoretical critical ratio. These modified characteristics considerably reduce uncertainty when calculating the gas flow injected into the tubing and help to facilitate the dimensioning, operation and automation of the well.

Figure 1:
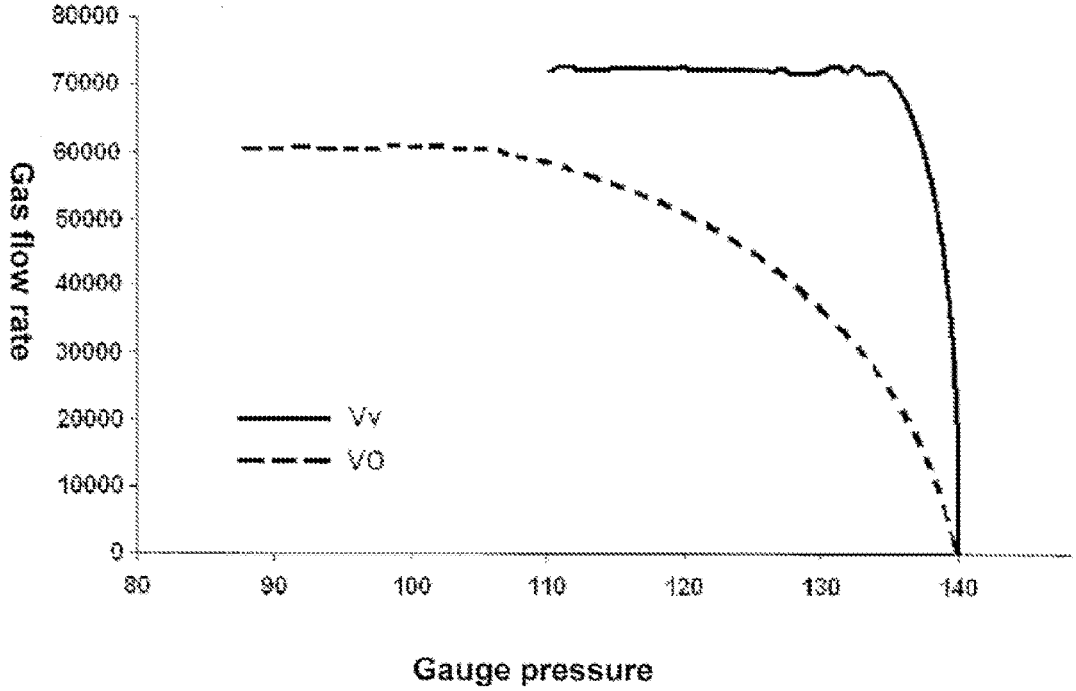
FIG. 1 Prior Art
FIG. 1 shows a graph comparing performance curves for an orifice valve and a venturi valve of the prior art.

The relationship between the gas flow passing through the valve and the pressure differential between admission and discharge of the valve is usually referred to as the "behaviour" or "dynamic performance" of a valve. FIG. 1 shows a graph comparing a performance curve of an orifice valve (VO) with a performance curve of a venturi valve (Vv).

To determine the values generating the performance curves, tests were carried out on a specific test unit for gas-lift valves using natural gas under an upstream gauge pressure of 140 bar and the diameters of the orifice and the throat of the venturi were equal.

The curves on the graph show that the behaviour of the two valves is quite distinct. The venturi valve (Vv) reaches a critical flow with a pressure difference (upstream-downstream) of less than 10% of the upstream pressure.

The orifice valve (VO) requires a pressure differential of between 35% and 45%, depending on the exact geometry of the valve.

As mentioned above, the venturi valve (Vv) is an important solution for some operational problems, because it is a valve that provides a near-constant gas flow and almost completely eliminates, for example, the phenomenon known as "casing heading", which is an oscillatory instability that occurs in certain wells that can cause major operational difficulties, and the other known means for controlling it in gas lifting can result in significant production losses in a well or significantly increase operating costs and system complexity.

However, it should be remembered that, in continuous gas lifting, the method most commonly used for adjusting injection flow in operation, regardless of whether or not there is any instability, is adjustment of the annulus pressure (also known as the "casing pressure"). The venturi valve (Vv), unlike the orifice valve (VO), has low sensitivity to casing pressure, i.e. the gas injection flow varies very little as the casing pressure increases or decreases, considering the practical ranges of variation of this pressure. Accordingly, designers of gas-lift installations often use orifice valves (VO) to benefit from the operational flexibility that they provide and, in the event of an unstable flow, they apply a corrective measure.

Calculation of the flow rate of gas passing through a gas-lift valve is essential both for the design and for the operation and automation of wells that use this artificial lifting method.

The mathematical models for a venturi valve (Vv) enable real performance to be extrapolated with a reasonable degree of precision. The flow through this type of valve is very similar to reversible adiabatic flow, i.e. isentropic flow, and even when the critical flow rate is established, the flow can be considered to be isentropic until the throat of the venturi. Since there is no practical need to model the flow in the diffuser once critical flow has been established through the valve, the calculation approach considering isentropic flow to the throat is quite reasonable. The shape of the nozzle ensures that the discharge coefficient is nearly equal to one. Thus, the isentropic model provides theoretical flow rate values that are quite close to the real values, requiring only minimal calibration with experimental data.

In the case of orifice valves, modelling is much more difficult, because the geometry of the valves introduces a very wide range of irreversibilities into the flow. The pressure differentials through the orifice plate are high and the diameters of the orifices and internal diameters of the valve itself are very small. The "vena contracta" (region of the fluid flow following passage through the orifice characterised in that the fluid flow remains contracted, having a diameter equal to or less than the diameter of the same fluid flow immediately following passage through the orifice) is difficult to model in this case. The critical ratio is also highly variable, since pressure recovery following the orifice, which still exists, although it is small, is difficult to predict.

The value of this critical ratio in venturi valves does not need to be known with any great precision in terms of modelling, because it only defines the minimum pressure differential required for operation in critical flow. In other words, it defines the minimum differential that the designer of the installation has to take into account to ensure that the venturi valve operates in the desired situation, i.e. in critical flow, never in sub-critical flow. In consideration of this, modelling is then only of interest for evaluating critical flow.

With orifice valves, the precise pressure recovery value needs to be known, because in the vast majority of cases operation is undertaken at sub-critical flow rates. Obtaining estimates that are not particularly representative of a real situation in terms of pressure recovery and estimates of "vena contracta" introduce significant errors into flow rate estimates, because only the pressures upstream and downstream of the valve as a whole are known. A comprehensive experimental evaluation is required and the discharge coefficient is significantly less than one and is very unpredictable in practical models.

In consideration of the foregoing, it is clear that designers are required to choose between two extremes: a valve with near-isentropic flow and critical ratio and discharge coefficient close to one that is easy to model but provides limited operational flexibility, or a valve with practically adiabatic flow, but with a high level of irreversibility, with operational flexibility, but that is difficult to model.

The present invention addresses this issue with a nozzle valve for gas lifting where the shape of this gas flow adjustment nozzle provides advantages such as:

- in terms of modelling, maintaining predictable dynamic behaviour;
- maintaining gas-flow control flexibility similar to an orifice valve; and
- also having a smooth geometry that induces a gradual acceleration of the fluid while increasing tolerance to erosion and other mechanical damage.

Purely by way of clarification, the components of the valves illustrated in FIGS. 2, 3 and 4 and described below are referenced alphabetically as they are valves that exist in the prior art.

Figure 2:
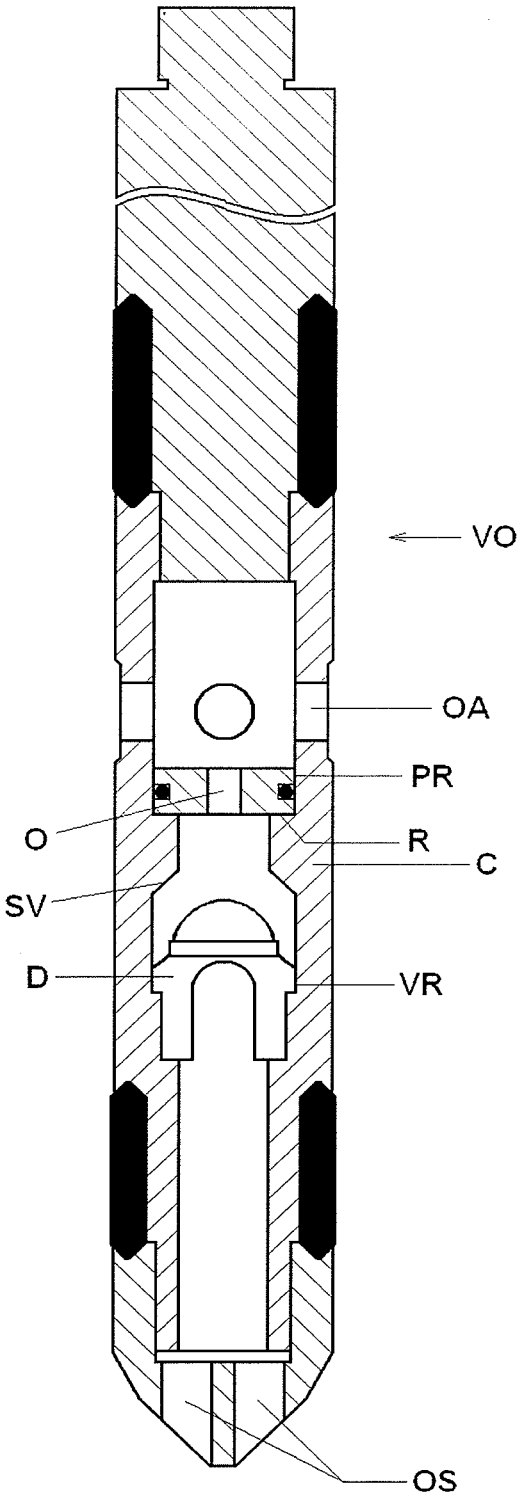
FIG. 2 Prior Art
FIG. 2 shows an orifice valve of the prior art.

FIG. 2 is a schematic longitudinal cross section of an orifice gas-lift valve (VO) of the prior art for use with side-pocket mandrels.

The orifice valve (VO) has a body (C) with admission orifices (OA) and a recess (R) in the internal diameter of the body where an orifice plate (PR) is fitted to regulate the gas flow. The gas coming from the annulus passes through the orifices of the mandrel (not shown), enters the orifice valve (VO) through admission orifices (OA), passes through an orifice (O), through the check valve (VR) and comes out through exit orifices (OS) of the nose of the orifice valve (VO), mixing thereafter with the fluids coming from the reservoir inside a tubing (CP).

The check valve (VR) shown is an "internal" check valve and is shown in the open position, enabling the passage of gas from the annulus towards the tubing (CP). If gas injection stops and fluids from inside the tubing (CP) start to flow in reverse, a dart (D) of the check valve (VR) is drawn until there is contact between the top of the dart (D) and the sealing seat (SV), preventing the progression of this unwanted flow.

Figure 3:
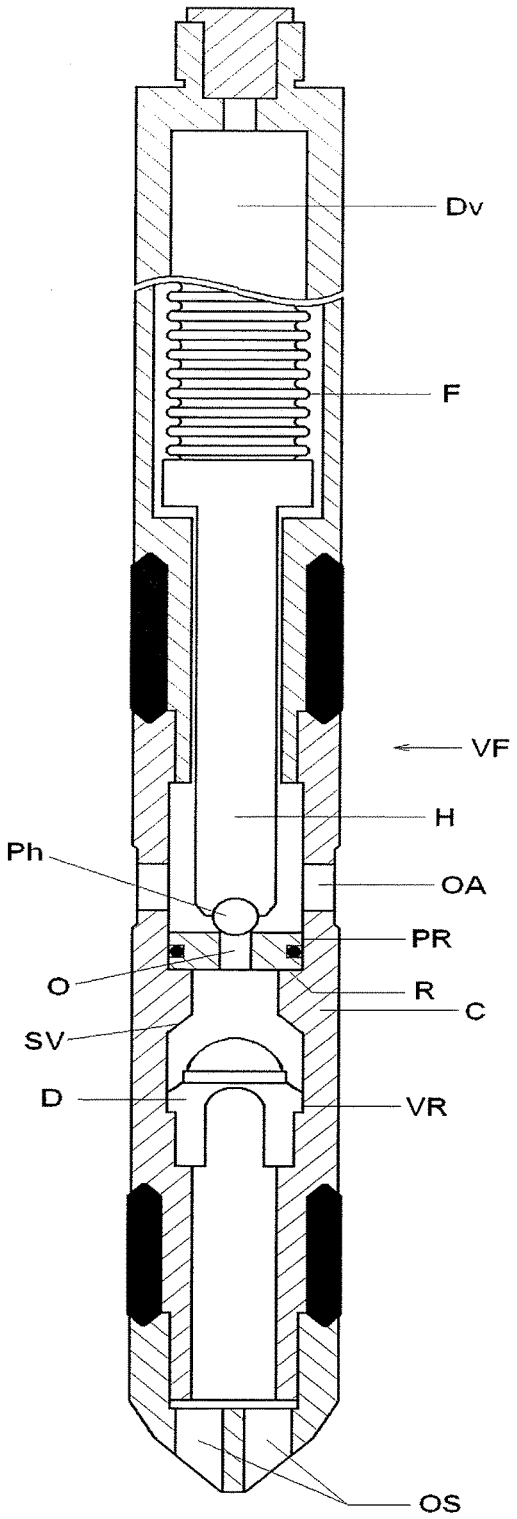
FIG. 3 Prior Art
FIG. 3 shows a charged-bellows valve of the prior art.

FIG. 3 is a schematic longitudinal cross section of a charged-bellows gas-lift valve belonging to and known from the prior art, also known as a "pressure valve".

The charged-bellows valve (VF) is similar to the orifice valve (VO), but it also has a rod (H) with a tip (Ph), which is usually spherical and made of a very hard material, that in the position shown in FIG. 3 causes the sealing of the orifice (O), preventing the flow of fluid from the annulus to the tubing and vice versa. The rod (H) is connected to a bellows (F) the internal space of which communicates with a small chamber, known as the "dome" (Dv) of the valve. The dome (Dv) and, consequently, the bellows (F) contain a gas, usually nitrogen, at a given pressure. Thus, the tip (Ph) of the rod (H) remains pressed against the orifice (O). As a result of the forces acting on the rod (H), forces deriving essentially from the action of the pressures of the gas in the bellows (F), of the gas in the annulus and of the fluid in the tubing (CP), the rod (H) can be kept in the position in FIG. 3, in which the charged-bellows valve (VF) is closed, or be moved such as to compress the bellows (F), enabling the passage of the gas through the orifice (O), in which case the charged-bellows valve (VF) is described as being open. When the tip (Ph) of the rod (H) is sufficiently removed from the orifice (O) that it does not obstruct the gas flow, the charged-bellows valve (VF) exhibits a dynamic behaviour similar to that of the orifice valve (VO).

Figure 4:
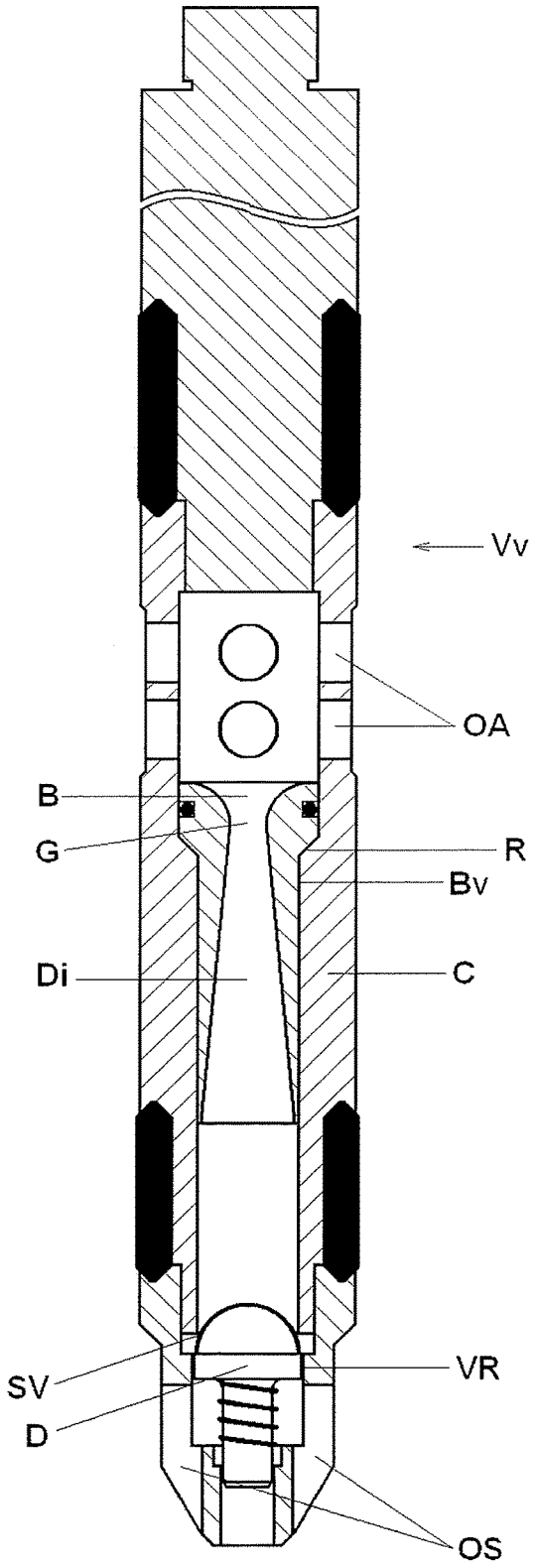
FIG.4 Prior Art
FIG. 4 shows a venturi valve of the prior art.

FIG. 4 is a schematic longitudinal cross section of a venturi gas-lift valve (Vv) of the prior art for use with side-pocket mandrels. The venturi valve (Vv) has a body (C) with admission orifices (OA) and a recess (R) in the internal diameter of the body (C) where a compact venturi or venturi nozzle (Bv) is fitted to regulate the gas flow. The venturi orifice may be divided for instructional purposes into three parts: the nozzle (B), the throat (G) and the diffuser (Di). The throat (G) is the smallest passage area open to the fluid flowing through the venturi. It may have an infinitesimal length, being merely a straight transitional section between the nozzle and the diffuser, or it may have a finite length.

The check valve (VR) shown is an "external" check valve and is shown in the closed position. The dart (D) is held in the position shown by a spring. If a pressure differential is applied between annulus and tubing (CP) that overcomes the resistance of the spring, the dart (D) is moved to a lower position, enabling the passage of gas from the annulus to the inside of the tubing (CP). If gas injection stops and fluids from inside the tubing (CP) start to flow in reverse, the dart (D) of the check valve (VR) returns to its original position, the top of this dart (D) pressing against the sealing seat (SV), preventing this unwanted flow.

Figure 5:
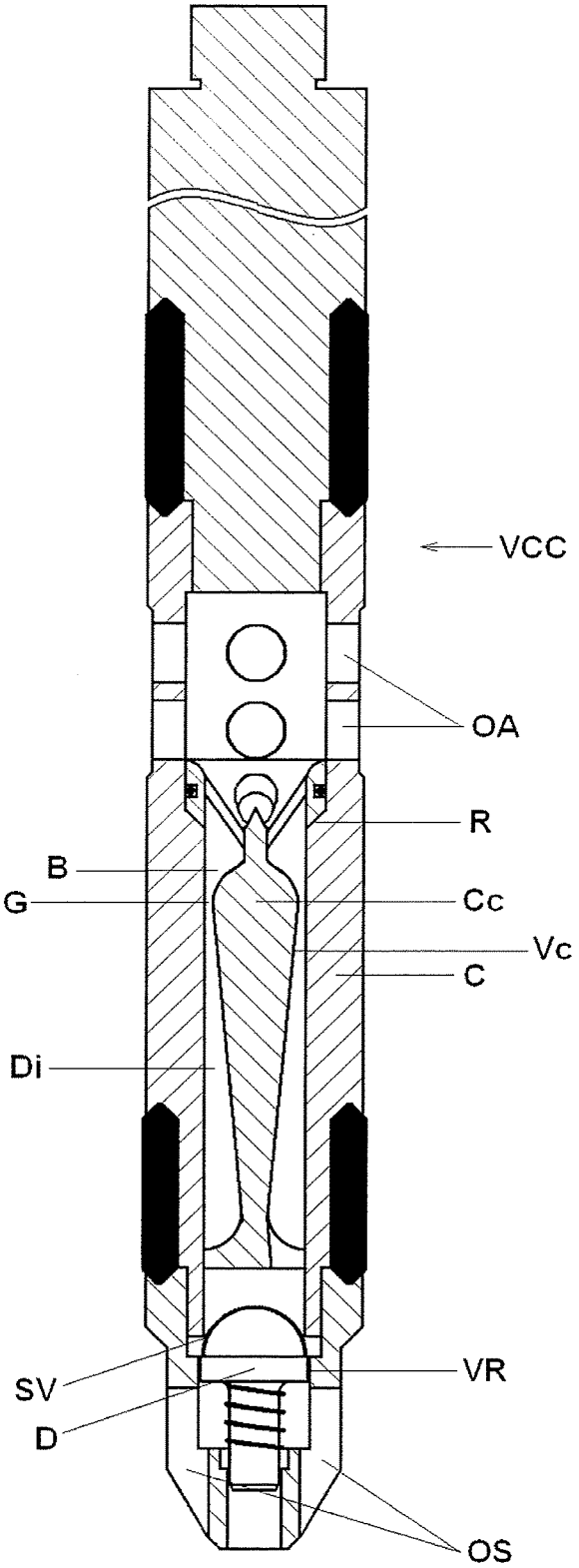
FIG.5 Prior Art
FIG. 5 shows a center-body venturi valve of the prior art.

FIG. 5 is a schematic longitudinal cross section of a center-body venturi gas-lift valve (VCC) from the prior art for use with side-pocket mandrels.

The only difference from the venturi valve (Vv) in FIG. 4 is the replacement of the conventional venturi (V) by a center-body venturi (Vc) which is an annular venturi with a nozzle (B), a throat (G) and a diffuser (Di) that perform the same functions as the corresponding parts in the conventional venturi (V). Equally, the throat (G) can have an infinitesimal length or a finite length.

Although there may be variations, in general the geometry of the central body (Cc) is such that, when comparing a conventional venturi with a central-body venturi (Vc), with the same passage area in the throat (G), the area of the annulus between the housing and the central body (Cc) in a straight section at a given distance from the throat (G) is equal to the area of the straight section of the conventional venturi (V) for the same distance from the throat (G). Thus, the area variation profile of the conventional venturi (V) is maintained as the area becomes annular.

The nozzle valve (GL) for gas lifting according to the present invention has a body (1) with admission orifices (2), and, immediately below these, a slight recess (3) in the internal diameter of the body (1) where a convergent nozzle (4) is fitted to regulate the gas flow passing through the inside of the valve towards the outlet (5) of the latter.

The preferred embodiments of the convergent nozzle (4), hereinafter referred to simply as the nozzle (4), are described below.

Figure 6:
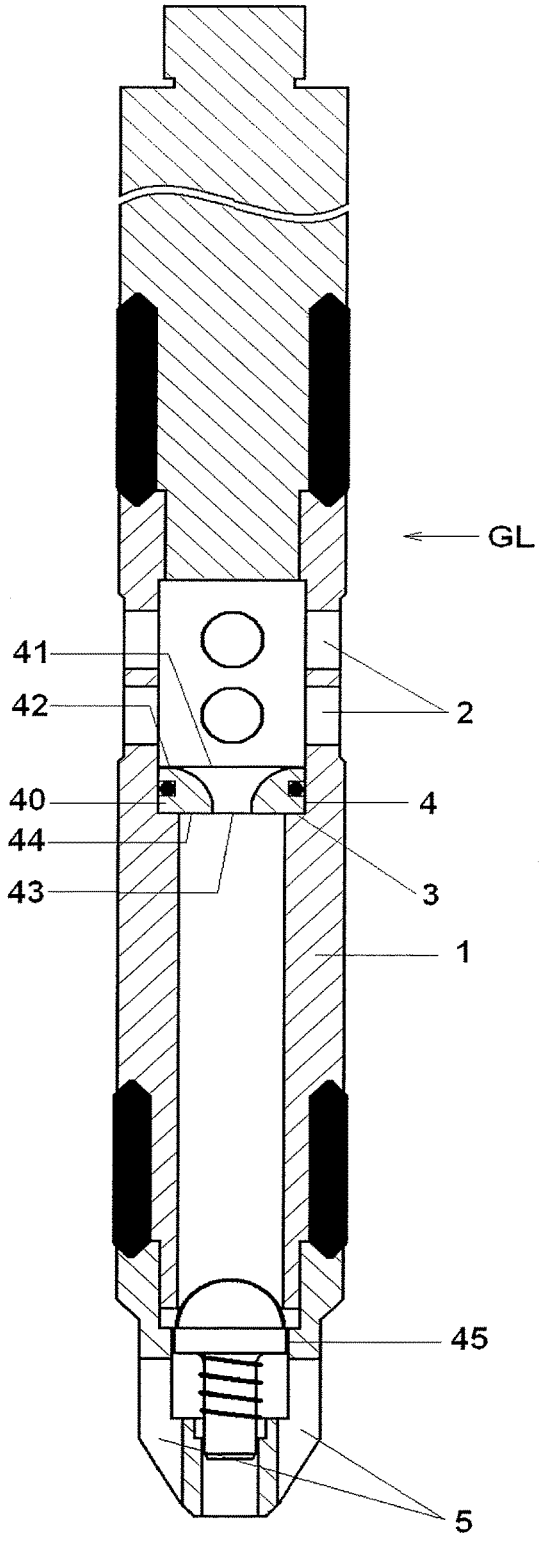
FIG. 6 shows a first embodiment of the nozzle according to the present invention.

In a first embodiment of the nozzle (4) according to the present invention to be fitted in a nozzle valve (GL) for gas lifting, shown in FIG. 6, it can be seen that it comprises a perforated toroidal (or torus) cylindrical block (40) with a larger opening (41) in the upper face (42) of the block (40) close to the admission orifices (2) of the valve and a smaller opening (43), or throat, in the lower face (44) of the block (40) oriented towards a check valve (VR) (45) located in the outlet (5) (or nose) of the valve.

The gas coming from the annulus of the well passes through the orifices of a mandrel (not shown), enters the valve through the admission orifices (2), passes through the nozzle (4), passes through the check valve (45) and goes out through 15 the outlet (5) of the valve, mixing thereafter with the fluids coming from the reservoir inside the tubing (not shown).

Figure 7:
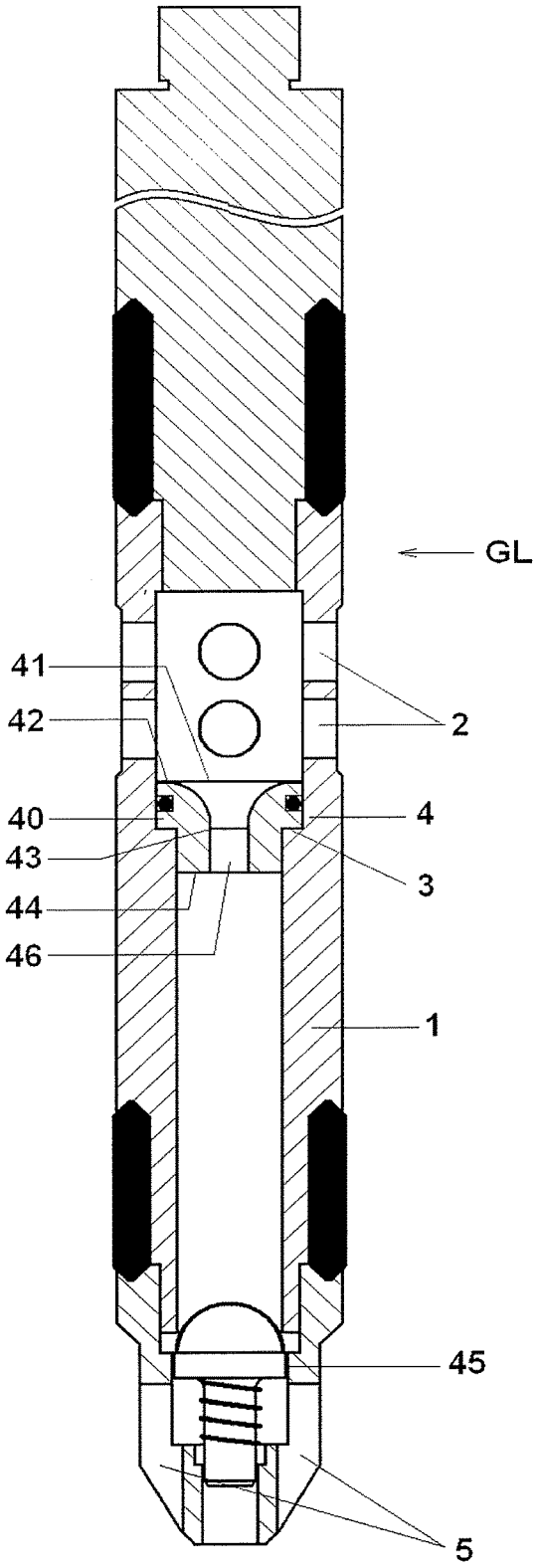
FIG. 7 shows a second embodiment of the nozzle according to the present invention.

In a second embodiment of the nozzle (4) according to the present invention to be fitted in a nozzle valve (GL) for gas lifting, shown in FIG. 7, it can be seen that it comprises a perforated toroidal cylindrical block (40) with the larger opening (41) in the upper face (42) close to the admission orifices (2) of the valve and the smaller opening (43) with an extension provided by the addition of a small cylindrical throat (46) having the same diameter as this smaller opening (43) that terminates in the lower face (44) oriented towards a check valve (45) located in the outlet (5) (or nose) of the valve.

Figure 8:
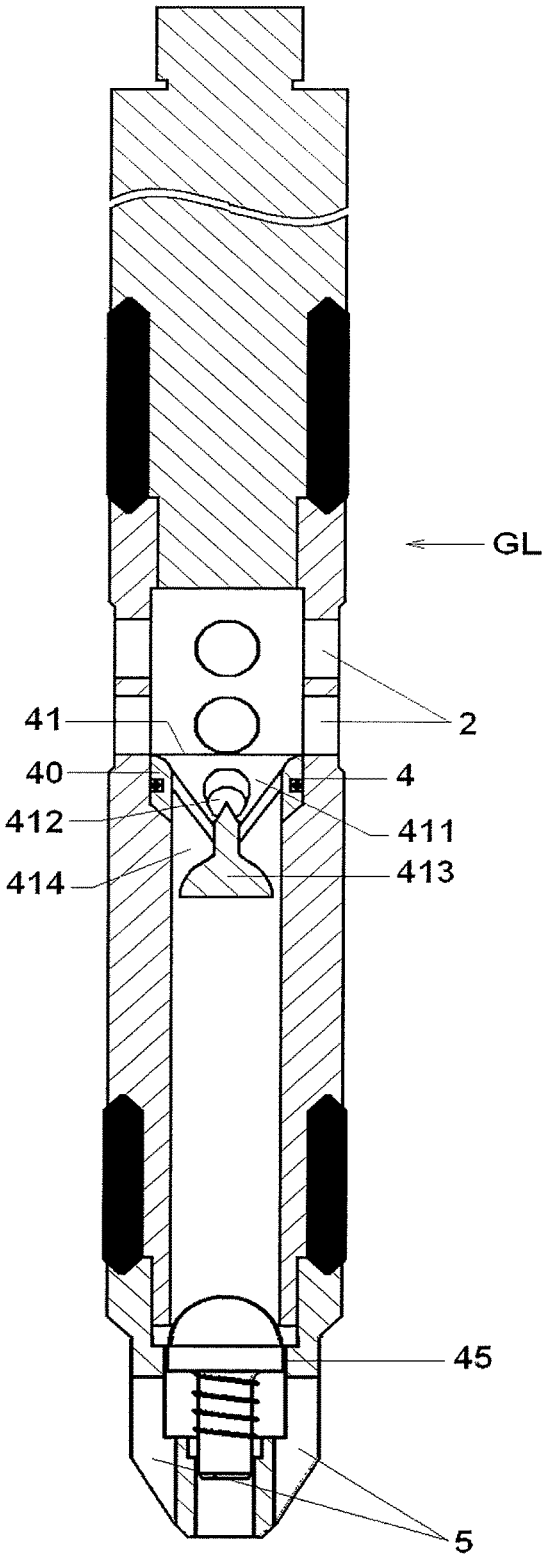
FIG. 8 shows a third embodiment of the nozzle according to the present invention.

In a third embodiment of the nozzle (4) according to the present invention to be fitted in a nozzle valve (GL) for gas lifting, shown in FIG. 8, it can be seen that it comprises a perforated cylindrical block (40) in the form of a center-body nozzle that in turn comprises an upper centring device (411), perforated with holes (412) followed by a central body (413) the diameter of which increases from the upper centring device (411) and forms an annulus (414) that gradually reduces the flow passage area from a larger opening oriented towards the gas admission orifices to a smaller opening that defines a smaller flow passage area, oriented towards the check valve (VR) (45) and towards the outlet (5) (or nose) of the valve.

Figure 9:
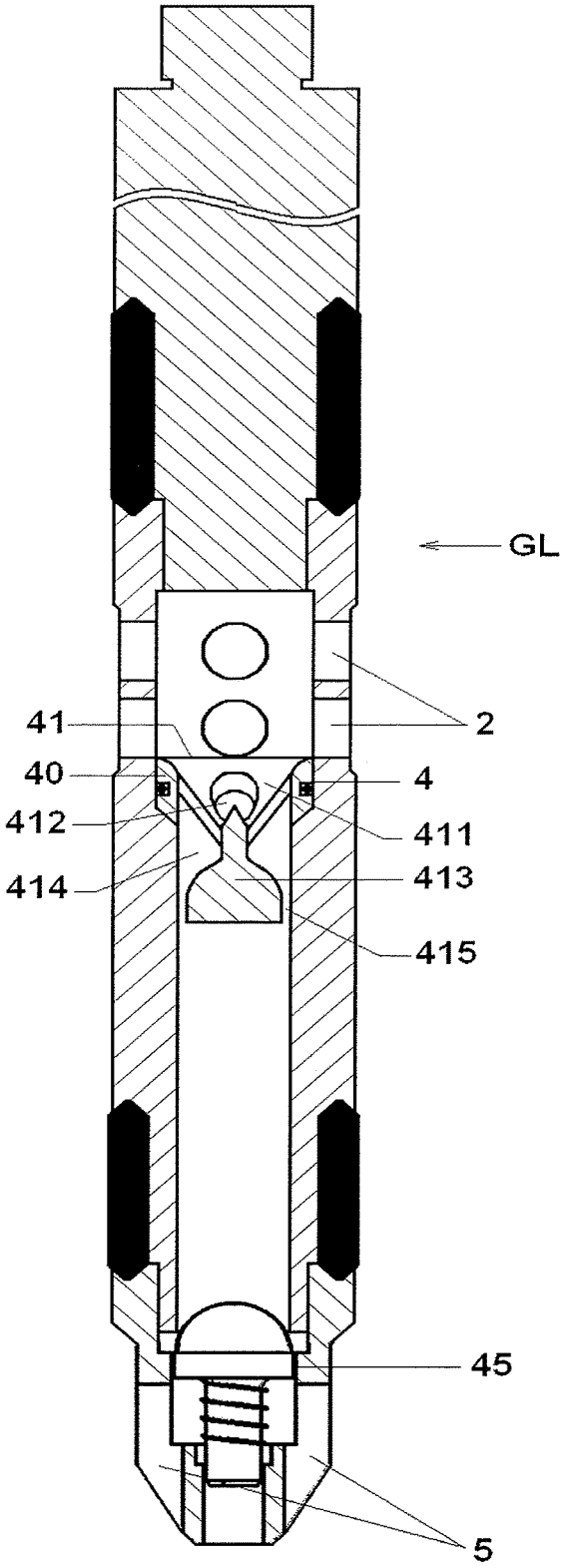
FIG. 9 shows a fourth embodiment of the nozzle according to the present invention.

In a fourth embodiment of the nozzle (4) according to the present invention to be fitted in a nozzle valve (GL) for gas lifting, shown in FIG. 9, it can be seen that it comprises a perforated cylindrical block (40) in the form of a center-body nozzle that in turn comprises an upper centring device (411), perforated with holes (412) followed by a central body (413) the diameter of which increases from the upper centring device (411) and forms an annulus (414) that gradually reduces the flow passage area from a larger opening oriented towards the gas admission orifices to a smaller opening that defines a smaller flow passage area, supplemented by a small cylindrical throat (415) of finite length, that defines the smaller flow passage area, oriented towards the check valve (45) and towards the outlet (5) (or nose) of the valve.

The charged-bellows nozzle valve (FC) for gas lifting according to the present invention has a body (1) with admission orifices (2), and, immediately below these admission orifices (2) there is a slight recess (3) in the internal diameter of the body (1) where a convergent nozzle (4) is fitted to regulate the gas flow passing through the inside of the valve (FC) towards the outlet of the latter and, above the admission orifices (2) a rod (6) connected to an actuating bellows (7).

Figure 10:
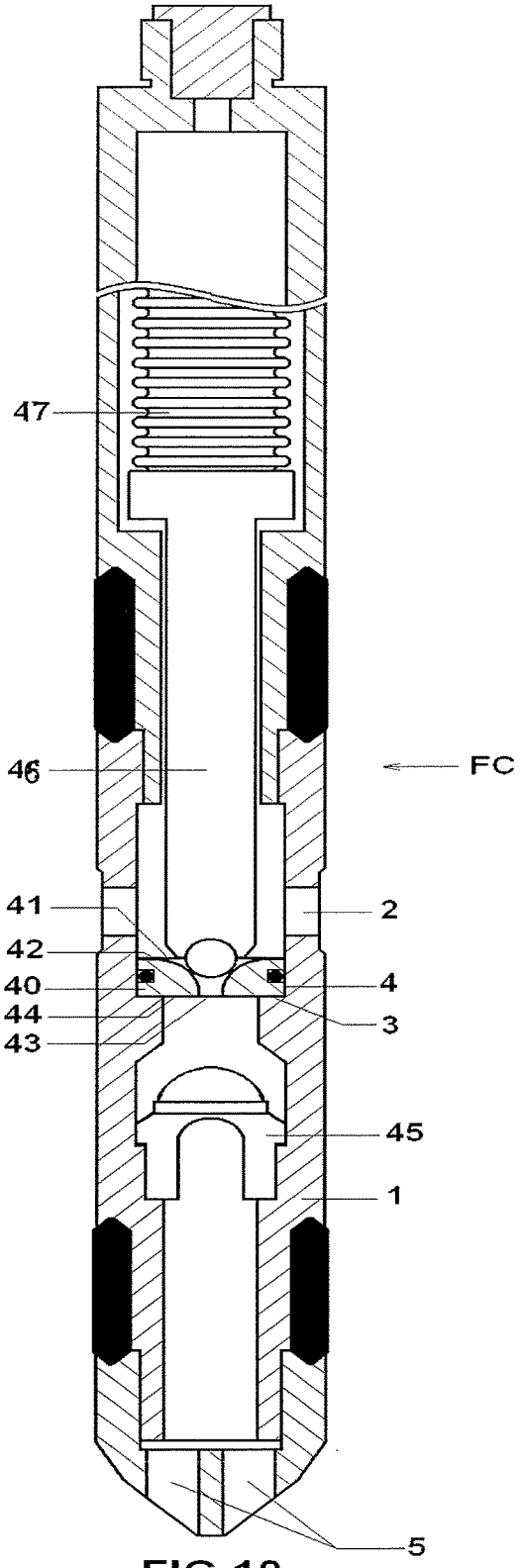
FIG. 10 shows a fifth embodiment of the nozzle according to the present invention.

In a fifth embodiment of the nozzle (4) according to the present invention to be fitted in a charged-bellows nozzle valve (FC) for gas lifting, shown in FIG. 10, it can be seen that it comprises a perforated toroidal cylindrical block (40) with a larger opening (41) in the upper face (42) of the block (40) close to the admission orifices (2) of the valve and a smaller opening (43), or throat, in the lower face (44) of the block (40), inside which is actuated the rod (6) linked to the bellows (7) of the charged-bellows gas-lift valve (FC).

Figure 11:
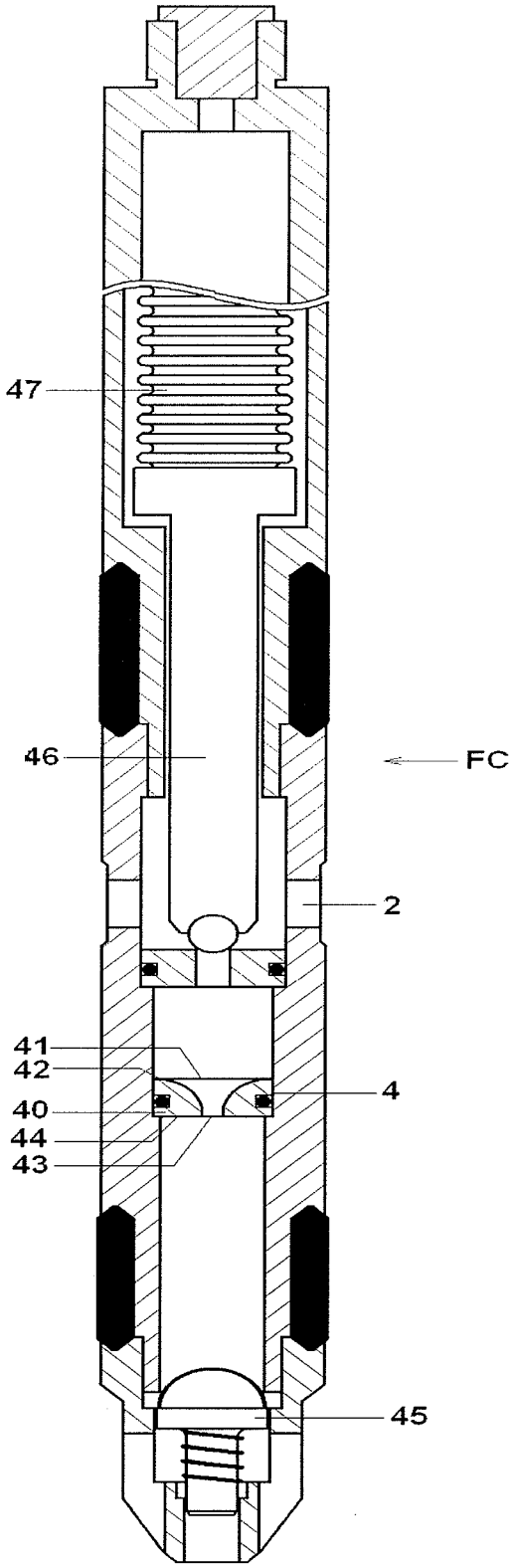
FIG. 11 shows a sixth embodiment of the nozzle according to the present invention.

In a sixth embodiment of the nozzle (4) according to the present invention to be fitted in a charged-bellows nozzle valve (FC) for gas lifting, shown in FIG. 11, it can be seen that it comprises a perforated toroidal cylindrical block (40) intended to replace a conventional orifice plate known in the prior art as a "choke", with a larger opening (41) in the upper face (42) of the block (40) and a smaller opening (43), or throat, having a diameter that may be less than or equal to the diameter of the opening of the conventional seat of the charged-bellows gas-lift valve (FC).

The present invention is flexible in application in relation to conventional gas-lift valves, and it may replace one or more components required to restrict gas flow, including by combining the embodiments described above, for example: in a charged-bellows gas-lift valve (FC), the main seat and the choke may be replaced by the nozzle in the first embodiment.

The check valves (45) shown in most of the figures are "external" check valves, which simply represents a preferential construction. There is no reason why an "internal" check valve, or even both types of check valves simultaneously, cannot be used. Other types of check valves other than those shown by way of example could be used in any of the embodiments.

The embodiments of nozzles (4) shown have a preferential geometric profile in cross section formed by circular arcs, but there is no reason why other known geometric forms in which the passage area is progressively reduced cannot be used. The nozzles (4) may be conical, and the arcs may be elliptical, parabolic, hyperbolic or any other curve deemed suitable for structural or other practical or operational reasons.

Tests with prototypes of the first embodiment and the second embodiment were carried out in a specific test unit for gas-lift valves using natural gas at an upstream gauge pressure of 140 bar.

Figure 12:
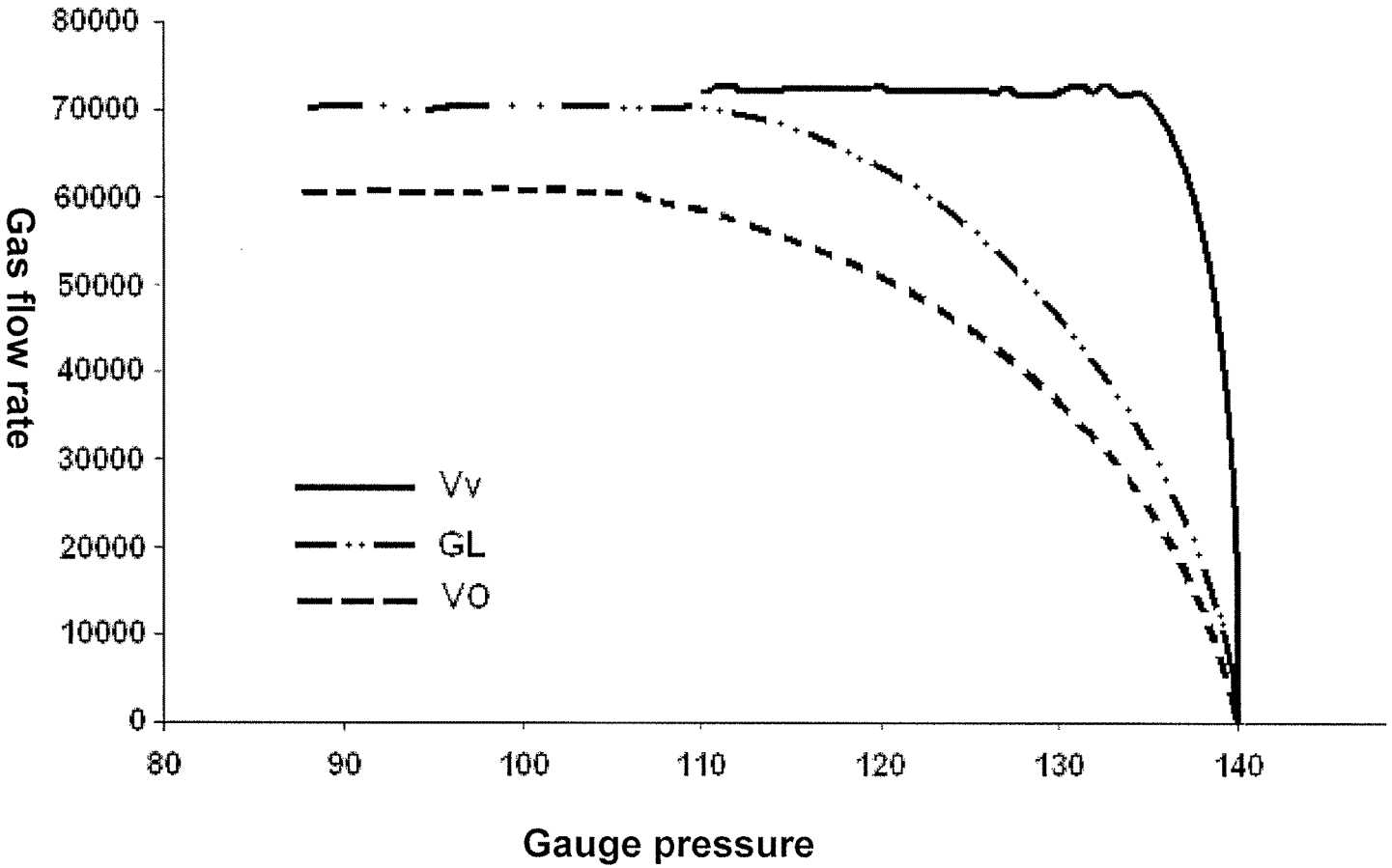
FIG. 12 shows a graph comparing performance curves for an orifice valve, a valve with nozzle and a conventional venturi valve.

A performance test was carried out with a gas-lift valve fitted with a conventional orifice, this orifice having a diameter of 5.2 mm. The same test was repeated for a nozzle valve (GL) for gas lifting fitted with a toroidal nozzle as in the first embodiment, in which the smaller opening had a diameter of 5.2 mm, and a conventional venturi valve (Vv) in which the throat diameter was 5.2 mm was then tested. The values obtained during the test were plotted as performance curves, as follows: a performance curve for the orifice valve (VO), a performance curve for a nozzle valve (GL) and a performance curve for a venturi valve (Vv), which are shown in the comparative graph in FIG. 12.

The discharge coefficients in relation to the flow rates calculated for a natural-gas isentropic-flow model had values such as 0.85 for the orifice valve (VO), 0.94 for the nozzle valve (GL) and 0.95 for the venturi valve (Vv).

In consideration of the above values, it can be concluded that, in terms of discharge coefficient, the nozzle (4) behaves identically or near-identically to the venturi (V), with a much more isentropic flow up to the throat (G) than that established in an orifice plate (PR). What distinguishes the dynamic behaviour as a whole is that in the venturi (V) there is a diffuser that provides pressure recovery. Thus, when the pressure downstream of the venturi (V) is 120 bar, for example, the pressure in the throat (G) thereof is approximately 75 bar and the flow in the throat (G) is critical (sonic). In a nozzle (4) that has no pressure recovery in sudden expansion, the pressure at the smaller opening will be nearer to 120 bar and the flow is sub-critical.

For the conditions of the test mentioned above, the theoretical isentropic gas flow model suggests a theoretical critical ratio of 0.53. The test demonstrated an experimental critical ratio of 0.64 for the nozzle, 0.56 for the orifice and 0.94 for the venturi (V). This demonstrates that the nozzle (4), even without a diffuser, provides greater pressure recovery downstream of the throat (G) than the orifice (O) (11% compared with 3% for the orifice). To adjust the critical ratio to bring it closer to the theoretical value, a cylindrical throat (G) of finite length may be used. Experiments carried out under the same conditions as the above test with a nozzle (4) fitted with a cylindrical throat (G) of a given length demonstrated the same discharge coefficient and a critical ratio equal to the theoretical ratio, which in this case is 0.53. Shorter lengths may be used to adjust the critical ratio to an intermediate value between the theoretical value and the value obtained with the nozzle (4) only without the finite-length throat (G). Greater lengths may be used to obtain a critical ratio lower than the theoretical ratio, increasing the size of the sub-critical region in the performance curve.

Although the present invention has been described in its preferred embodiment, the principal concept that orients the present invention, which is a nozzle valve (GL) for gas lifting such that this valve can replace conventional orifice valves by building and coupling to the body of the latter convergent nozzles that, on account of their geometric shape, retain the existing desirable characteristics of orifice valves, with the advantage of providing a discharge coefficient close to one and a real critical ratio close to the theoretical critical ratio, retains its innovative nature, to which a person normally skilled in the art could conceive of and implement variations, modifications, alterations, adaptations and similar that are suitable and compatible with the working medium in question, without thereby moving outside the spirit and scope of the present invention, which are set out in the claims below.

The invention claimed is:

1. A nozzle valve for gas lifting, comprising:

a body (1) with admission orifices (2);

a recess (3) provided below the admission orifices in an inside of the body, and a convergent nozzle (4) configured to regulate a gas flow passing through the inside of the body towards a valve outlet (5), wherein the nozzle comprises a perforated cylindrical block (40) provided on the recess with a large opening (41) provided at a first end of the block and with a small opening (43) provided at a second end of the block opposite to the first end, wherein an internal diameter of the large opening (41) is larger than an internal diameter of the small opening (43), wherein the small opening (43) corresponds to the minimum passage area for the gas flow through the inside of the body, wherein the nozzle between the first and second ends of the block is non-divergent, wherein the perforated cylindrical block (40) comprises a portion of a surface of a torus extending from the large opening to the small opening, and wherein the nozzle (4) further comprises a charged-bellows gas-lift valve, above the admission orifices (2), with a rod (6) connected to an actuating bellows (7), which acts inside the perforated cylindrical block (40).

2. The nozzle valve for gas lifting according to claim 1, wherein the nozzle (4) comprises the perforated cylindrical block (40), in toroidal form, with the large opening (41) in an upper face (42) of the block (40) and the small opening (43) in a lower face (44) of the block (40).

3. The nozzle valve for gas lifting according to claim 2, wherein the nozzle (4) further comprises a charged-bellows gas-lift valve, above the admission orifices (2), with a rod (6) connecting to an actuating bellows (7) which acts over a conventional seat, and forms a choke with the larger opening of the cylindrical block (40), and the smaller opening having a diameter less than or equal to the diameter of the opening of the conventional seat.

4. The nozzle valve for gas lifting according to claim 2, wherein the nozzle (4) further comprises an extension provided by the addition of a cylindrical throat (46) having the same internal diameter as the small opening (43) in the lower face (44) of the block (40).

5. The nozzle valve for gas lifting according to claim 4, wherein the nozzle (4) further comprises a charged-bellows gas-lift valve, above the admission orifices (2), with a rod (6) connecting to an actuating bellows (7) which acts over a conventional seat, and forms a choke with the larger opening of the cylindrical block (40), and the smaller opening having a diameter less than or equal to the diameter of the opening of the conventional seat.

6. The nozzle valve for gas lifting according to claim 1, wherein the nozzle (4) further comprises a charged-bellows gas-lift valve, above the admission orifices (2), with a rod (6) connecting to an actuating bellows (7), which acts over a conventional seat, and forms a choke with the larger opening of the cylindrical block (40), and the smaller opening having a diameter less than or equal to the diameter of the opening of the conventional seat.

7. The nozzle valve for gas lifting according to claim 1, wherein the nozzle (4) has a circular, conical, elliptical, parabolic or hyperbolic geometric cross section.

8. The nozzle valve for gas lifting according to claim 1, wherein a check valve (45) is positioned externally, internally or in a combination of both in relation to the nozzle valve.

9. The nozzle valve for gas lifting according to claim 1, wherein the nozzle (4) comprises the perforated cylindrical block (40), in toroidal form, with the large opening (41) on an upper-most face (42) of the block (40) and the small opening (43) on a lower-most face (44) of the block (40).

10. The nozzle valve for gas lifting according to claim 9, wherein the nozzle (4) further comprises a cylindrical throat (46) extending from the small opening (43) toward the outlet (5) and having an internal diameter same as the small opening (43) in the lower-most face (44) of the block (40) throughout an entire length of the cylindrical throat (46).

11. The nozzle valve for gas lifting according to claim 1, wherein a length of the convergent nozzle in an axial direction is equal to a distance between the large opening (41) and the small opening (43).

12. A nozzle valve for gas lifting, comprising:

a body (1) with admission orifices (2);

a recess (3) provided below the admission orifices in an inside of the body, a convergent nozzle (4) configured to regulate a gas flow passing through the inside of the body towards a valve outlet (5); and a check valve (45) positioned externally, internally or in a combination of both, wherein the nozzle comprises a perforated cylindrical block (40) provided on the recess with a large opening (41) provided at a first end of the block and with a small opening (43) provided at a second end of the block opposite to the first end, wherein an internal diameter of the large opening (41) is larger than an internal diameter of the small opening (43), wherein the small opening (43) corresponds to the minimum passage area for the gas flow through the inside of the body (1) when the check valve (45) is in the open position, wherein the nozzle between the first and second ends of the block is non-divergent, wherein the perforated cylindrical block (40) comprises a portion of a surface of a torus extending from the large opening to the small opening, and wherein the nozzle (4) further comprises a charged-bellows gas-lift valve, above the admission orifices (2), with a rod (6) connected to an actuating bellows (7), which acts inside the perforated cylindrical block (40).

* * * * *